US006756552B2

(12) United States Patent
Takenaka et al.

(10) Patent No.: US 6,756,552 B2
(45) Date of Patent: Jun. 29, 2004

(54) MULTI-POLE CONDUCTIVE LIQUID-BASED SWITCH DEVICE

(75) Inventors: Tsutomu Takenaka, Tokyo (JP); You Kondoh, Kanagawa (JP)

(73) Assignee: Agilent Technologies, Inc., Palo Alto, CA (US)

( * ) Notice: Subject to any disclaimer, the term of this patent is extended or adjusted under 35 U.S.C. 154(b) by 104 days.

(21) Appl. No.: 10/080,648

(22) Filed: Feb. 21, 2002

(65) Prior Publication Data

US 2002/0121432 A1 Sep. 5, 2002

(30) Foreign Application Priority Data

Feb. 23, 2001 (JP) ..... 2001-049481
Feb. 28, 2001 (JP) ..... 2001-054251

(51) Int. Cl.[7] ..... H01H 29/22

(52) U.S. Cl. ..... 200/224; 200/182; 200/187; 200/188; 200/214; 200/221; 200/228; 200/229

(58) Field of Search ..... 200/224, 182, 200/187, 188, 214, 221, 228, 229; 29/602.1

(56) References Cited

U.S. PATENT DOCUMENTS 6,211,756 B1 4/2001 Sun et al.

6,323,447 B1 * 11/2001 Kondoh et al. ..... 200/182

FOREIGN PATENT DOCUMENTS

| | | |
|---|---|---|
| JP | 3044101 | 12/1997 |
| JP | A 9161640 | 6/2000 |
| JP | 2002-25410 | 1/2002 |
| WO | WO 00/41198 | 7/2000 |
| WO | WO 01/46975 | 6/2001 |

* cited by examiner

*Primary Examiner*—Elvin Enad
*Assistant Examiner*—Jennifer A. Poker
(74) *Attorney, Agent, or Firm*—Ian Hardcastle

(57) ABSTRACT

The multi-pole, conductive liquid-based switch device includes an elongate passage, a first cavity, a second cavity, at least four electrodes disposed along the length of the passage, channels that extend from the passage, non-conductive fluid located the cavities and conductive liquid located in the passage. The channels are one fewer in number than the electrodes and are interleaved with the electrodes along the length of the passage. The channels are numbered in order from one end of the passage. Odd-numbered ones of the channels extend to the first cavity while even-numbered ones of the channels extend to the second cavity.

20 Claims, 5 Drawing Sheets

MULTI-POLE CONDUCTIVE LIQUID-BASED SWITCH DEVICE

BACKGROUND OF THE INVENTION

Switching high-frequency electronic signals, such as electronic signals at ultra-high frequencies and beyond, presents substantially greater challenges than switching lower-frequency electronic signals. Such signals are carried by various types of transmission media such as coaxial cables and transmission lines to reduce signal losses. Whereas a single pair of contacts suffices to switch a low-frequency signal, complex switching arrangements are required to switch high-frequency signals in a manner that provides low signal losses, high isolation and appropriate termination impedances.

Relays are typically used in applications in which a high-frequency signal is switched in response to an electrical control signal. Relays, in which an electromagnetic coil actuates a pair of mechanical switching contacts, offer advantages of low capacitance, high isolation, low ON resistance and a high isolation between the control signal and the switched signal. When relays are used to switch high-frequency signals, multiple, commonly-controlled relays, each including its own electromagnetic coil, are often required to perform the desired switching function. The number of relays requires depends on the application.

FIG. 1 is a schematic diagram of an example 10 of a step attenuator for high-frequency signals. The step attenuator is composed of single-pole, double-throw relays 12 and 14, attenuator 16 and transmission lines 18, 19 and 20. Relay 12 is composed of electromagnetic coil 22 and a single-pole, double-throw switch having contacts 23, 24 and 25. Relay 14 is composed of electromagnetic coil 26 and a single-pole, double-throw switch having contacts 27, 28 and 29. Contact 23 of relay 12 is connected to input terminal 30. Contact 29 of relay 14 is connected to output terminal 27. Transmission line 18 interconnects contacts 24 and 27. Transmission line 19, attenuator 16 and transmission line 20 are connected in series between contacts 25 and 28.

In the switching state of step attenuator 10 shown in FIG. 1, no control signal is applied to the electromagnetic coils 22 and 26 of relays 12 and 14, respectively. In this switching state, input terminal 30 is connected to output terminal 32 via contacts 23 and 24 of relay 12, transmission line 18 and contacts 27 and 29 of relay 14. The step attenuator operates as a through line in this switching state.

A control voltage applied to electromagnetic coils 22 and 26 causes relays 12 and 14, respectively, to change to their other switching states. In this switching state, input terminal 30 is connected to one end of attenuator 16 via contacts 23 and 25 of relay 12 and transmission line 19. The other end of the attenuator is connected to output terminal 32 via transmission line 20 and contacts 28 and 29 of relay 14. In this switching state, step attenuator 10 operates as an attenuator, providing an attenuation determined by the attenuation provided by attenuator 16.

The circuit shown in FIG. 1 may also form the basis of a stepped delay circuit for a high-frequency signal. In such stepped delay circuit, a delay line (not shown) providing a predetermined delay is substituted for attenuator 16 in the circuit shown in FIG. 1.

FIG. 2 is a schematic diagram of an example 50 of an impedance-matched single-pole, double-throw switch for high-frequency signals. Switch 50 incorporates four single-pole, single-throw relays 51, 52, 53 and 54. Relays 51, 52, 53 and 54 are composed of contacts 61, 62, 63 and 64, respectively, and electromagnetic coils 71, 72, 73 and 74, respectively. Coaxial reed-relays may be used as relays 51–54. Switch 50 is additionally composed of termination resistors 56 and 58, signal connections 66, 76 and 78 and transmission lines 80, 82, 84, 86, 88 and 90.

Termination resistors 56 and 58 have a resistance equal to the characteristic impedance of the system in which switch 50 is to be used. The characteristic impedance is typically 50 Ω. Signal connections 66, 76 and 78 provide connections for the high-signal to be switched by switch 50. For example, signal connection 66 may be an input connection and signal connections 76 and 78 may be output connections. Alternatively, signal connections 76 and 78 may be input connections, and signal connection 66 an output connection.

Transmission lines 80 and 82 connect signal connection 66 to contacts 61 and 62 of relays 51 and 52, respectively. Transmission line 84 connects contacts 61 to signal connection 76. Transmission line 86, contacts 63 of relay 53 and termination resistor 56 are connected in series between contacts 61 and ground. Transmission line 88 connects contacts 62 to signal connection 78. Transmission line 90, contacts 64 of relay 54 and termination resistor 58 are connected in series between contacts 62 and ground.

In the switching state of impedance-matched, single-pole, double-throw switch 50 shown in FIG. 2, a control signal is applied to the electromagnetic coils 71 and 74 of relays 51 and 54, respectively, and no control signal is applied to the electromagnetic coils 72 and 73 of relays 52 and 53, respectively. In the examples for the relays shown, a control signal applied to the electromagnetic coil closes the switch contacts. In the switching state shown in FIG. 2, signal connection 66 is connected to signal connection 76 by transmission line 80, contacts 61 of relay 51 and transmission line 84. Signal connection 78 is connected to ground through transmission lines 88 and 90, switch contacts 64 of relay 54 and termination resistor 58. Thus, signal connection 66 and signal connection 76 are electrically connected while signal connection 78 is isolated from the other signal connections and is connected to ground through termination resistor 58.

In the alternative switching state of switch 50, a control signal is applied to the electromagnetic coils 72 and 73 of relays 52 and 53, respectively, and the control signal is removed from the electromagnetic coils 71 and 74 of relays 51 and 54, respectively. The change in control signals reverses the states of the switch contacts from that shown in FIG. 2. Signal connection 66 is connected to signal connection 78 and signal connection 76 is isolated from the other signal terminals and is connected to ground through termination resistor 56.

The relays used in the above-described circuits for high-frequency signals have a substantially larger volume than that of most other components used in modern high-frequency electronic circuits. The volume of a commercially-available transfer-type reed relay for high-frequency electronic signals is about 0.7 ml.

Test sets for testing high-frequency signals and for testing other apparatus that generate, process or receive high-frequency signals typically include many examples of the circuits shown in FIGS. 1 and 2. Such test sets may include embodiments of the above-described step attenuator having multiple attenuation steps, each of which requires two reed relays. Such test sets may additionally include several examples of the double-pole, double-throw impedance matched switch shown in FIG. 2 for selectively routing high-frequency signals in the test set. Accordingly, examples of such test sets that employ conventional switching circuits include a large number of reed relays. The aggregate volume of the reed relays and their associated drive circuits represents a substantial fraction of the volume of the test set.

Moreover, some commercially-available single-pole, double-throw switches incorporate coaxial reed relays to improve their impedance matching characteristics. However, the volume of a single-pole, double-throw switch incorporating coaxial reed relays is over 30 ml because the volume of the coaxial reed relays and their drive circuits is large. The volume of such switches is too large to allow many of them to be used in test sets and in other apparatus in which it is desired to reduce the overall volume of the apparatus.

The signal transmission properties of the reed relays used in the circuits described above are less than ideal, especially at higher frequencies. For example, the maximum frequency of the commercially-available transfer type RF reed relays used in step attenuator 10 shown in FIG. 1 can be as low as about 500 MHz. This is because of the large impedance mismatch between the reed relay and the transmission lines to which it is connected. Also, the attenuation of an input signal between signal connection 30 and signal connection 32 may be less than that provided by attenuator 16 due to coupling between transmission lines 19 and 20 and transmission line 18. This effect is worse when attenuator 16 provides a large attenuation and when the frequency of the signal is high.

The switching characteristics of switch 50 shown in FIG. 2 degrade at frequencies above those at which the wavelength is comparable with the size of the switch. Since the size of the switch is large, the switching characteristics degrade above a relatively low frequency. Commercially-available impedance matched, single-pole, double-throw switches based on the structure in FIG. 2 have a maximum frequency of about 1 GHz. A possible reason for this is that transmission lines 80 or 82 and 86 or 90 become open stubs on the internal transmission lines of the coaxial reed relays. The switching characteristics are degraded when the size of the transmission lines cannot be ignored in relation to the wavelength of the high-frequency signal.

Thus, what is needed for switching high-frequency signals is a switch device that is smaller in size than conventional switch devices. What is also needed is a switch device that does not suffer from the above-described performance shortcomings of conventional switch devices, especially at high signal frequencies. What is also needed is a switch device capable of switching signals having a substantially higher maximum frequency than conventional switch devices.

SUMMARY OF THE INVENTION

The invention provides a multi-pole, conductive liquid-based switch device that includes an elongate passage, a first cavity, a second cavity, at least four electrodes disposed along the length of the passage, channels that extend from the passage, non-conductive fluid located the cavities and conductive liquid located in the passage. The channels are one fewer in number than the electrodes and are interleaved with the electrodes along the length of the passage. The channels are numbered in order from one end of the passage. Odd-numbered ones of the channels extend to the first cavity while even-numbered ones of the channels extend to the second cavity.

A step attenuator or step delay device functionally similar to the step attenuator or step delay device shown in FIG. 1 can be made using a single multi-pole, conductive liquid-based switch device according to the invention with four poles. An impedance-matched, single-pole, double-throw switch for high-frequency signals similar to that shown in FIG. 2 can be made using a single multi-pole, conductive liquid-based switch device according to the invention with five poles. The volume of the step attenuator, the step delay device and the impedance-matched, single-pole, double-throw switch is substantially smaller than functionally-equivalent circuits fabricated using conventional reed-relays. Control signal routing is also simplified by only one switch device needing to be controlled.

Embodiments of the multi-pole, conductive liquid-based switch device according to the invention can include a ground plane and the passage and the electrodes can be structured as strip lines having a specific characteristic impedance that matches the characteristic impedance of the application in which the switch device is used. Signal losses and signal reflections are therefore smaller than with conventional reed-relays.

DETAILED DESCRIPTION OF THE INVENTION

Compact switch devices based on a conductive liquid are known. An example of such a switch device is disclosed in U.S. Pat. No. 6,323,447, assigned to the assignees of this disclosure and, for the United States, incorporated herein by reference. Improved conductive liquid-based switch devices are described in published International patent application no. WO 01/46975, assigned to the assignees of this disclosure and, for the United States, incorporated herein by reference. Advantages of conductive liquid-based switch devices include small size, low power consumption, low ON resistance, low OFF capacitance, high isolation between the control signal and the signal being switched and a long service life, etc.

The conductive liquid-based switch devices described in published International patent application no. WO 01/46975 can simply be substituted for the reed relays in the circuit shown in FIG. 1. The conductive liquid-based switch devices described in U.S. Pat. No. 6,323,447 or those described in published International patent application no. WO 01/46975 can simply be substituted for the reed relays in the circuit shown in FIG. 2. Such substitution would provide a substantial reduction in volume, together with the other advantages of conductive liquid-based switch devices described above. However, the circuit shown in FIG. 1 would require two conductive liquid-based switch devices and the circuit shown in FIG. 2 would require four. Notwithstanding the smaller size of the individual conductive liquid-based switch devices, the number of switch devices required in each application represents a substantial volume. Moreover, an electrical connection must be provided to each switch device to control its switching state.

Figure 1:
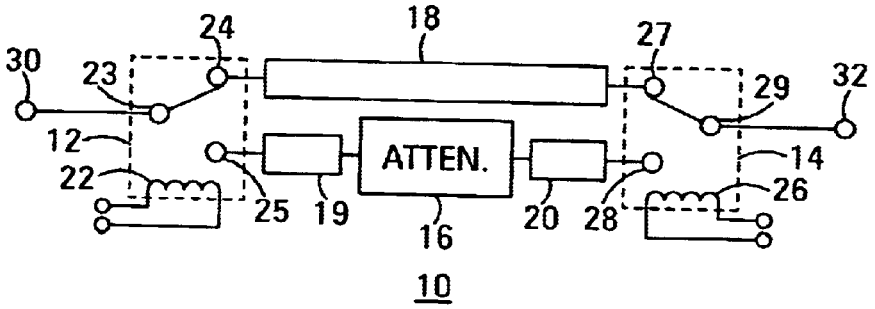
FIG. 1 (PRIOR ART)
FIG. 1 is a schematic diagram of an example of a conventional step attenuator for high-frequency signals.
Figure 2:
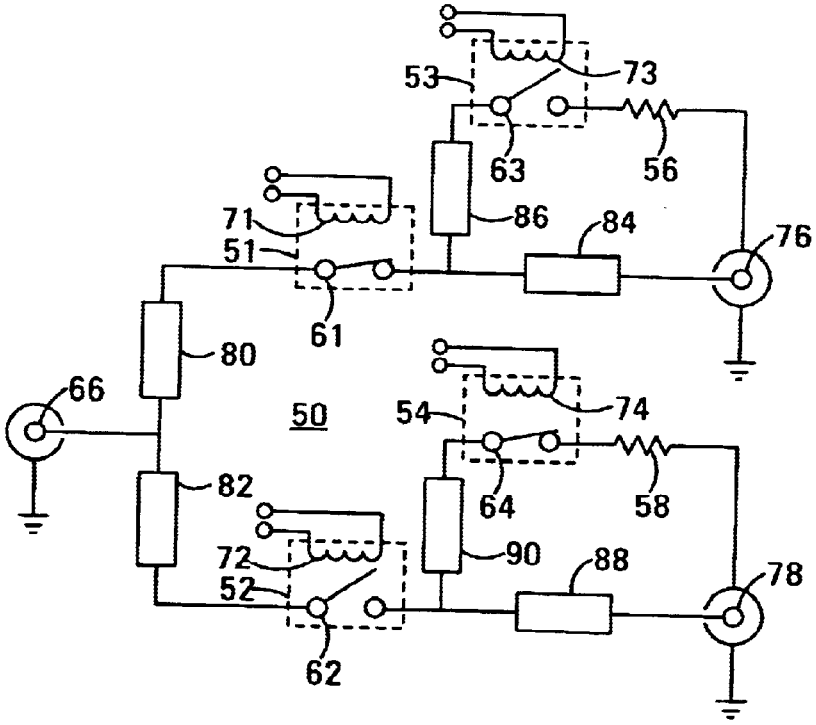
FIG. 2 (PRIOR ART)
FIG. 2 is a schematic diagram of a conventional impedance-matched single-pole, double-throw switch for high-frequency signals.

The invention provides a switch device that enables the circuits shown in FIGS. 1 and 2, and other high frequency circuits that use multi-pole, multi-throw switch devices, to be made using a single conductive liquid-based switch device. The switch device according to the invention provides a further reduction in volume, simplified control and improved performance over the switch devices described in U.S. Pat. No. 6,323,447 and published International patent application no. WO 01/46975.

Figure 3A:
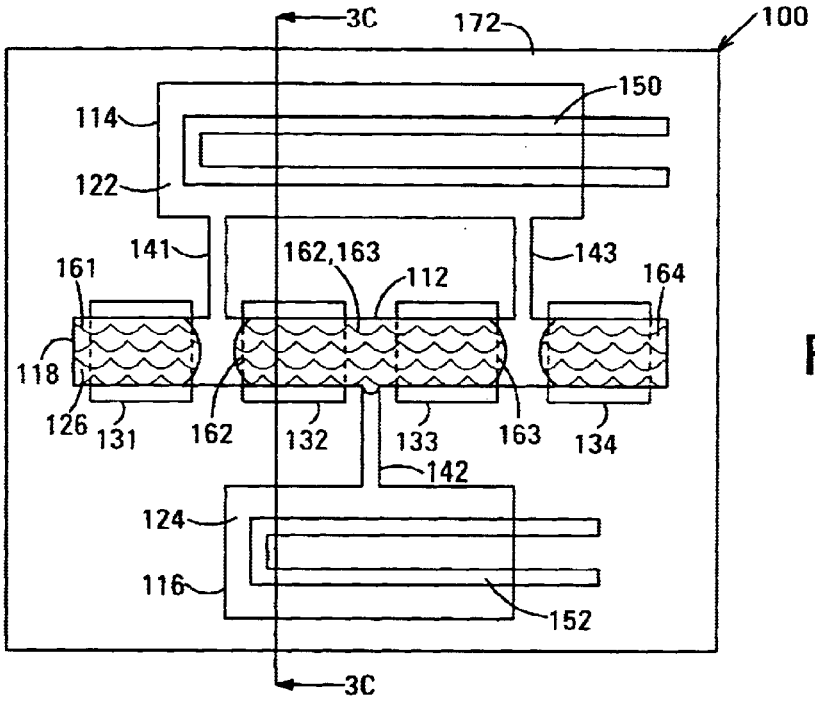
FIG. 3A is a plan view of a first embodiment of a multi-pole conductive liquid-based switch device according to the invention in a first switching state.
Figure 3B:
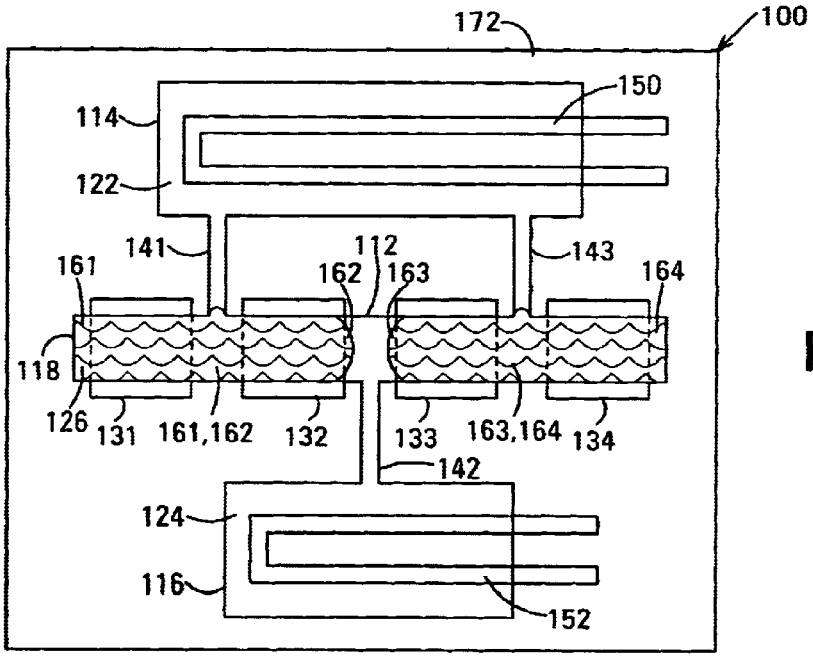
FIG. 3B is a plan view of the first embodiment of the multi-pole conductive liquid-based switch device according to the invention in a second switching state.
Figure 3C:
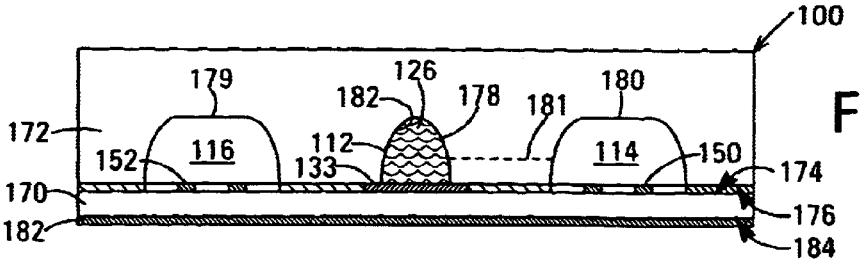
FIG. 3C is a cross-sectional view of the first embodiment of a multi-pole conductive liquid-based switch device according to the invention along the section line 3C—3C shown in FIG. 3A.

A first embodiment 100 of a multi-pole conductive liquid-based switch device according to the invention is shown in a first switching state in FIG. 3A and in a second switching state in FIG. 3B. A cross-sectional view is shown in FIG. 3C. Switch device 100 has properties that make it especially suitable for switching high-frequency electronic signals, which, for the purpose of this disclosure, will be regarded as being electronic signals in the ultra-high frequency (UHF) band and beyond. However, switch device 100 is additionally suitable for switching lower frequency signals. Practical embodiments of switch device 100 have a volume of about 0.02 ml.

Switch device 100 is a four-pole, two-way switch device and is composed of elongate passage 112, cavity 114, cavity 116, electrodes 131, 132, 133 and 134, channels 141, 142 and 143, non-conductive fluid 122 and 124 and conductive liquid 126.

Electrodes 131, 132, 133 and 134 contact conductive liquid 126 and are disposed along the length of passage 112.

Channels 141, 142 and 143 are one fewer in number than electrodes 131, 132, 133 and 134. The channels extend from passage 112 and are interleaved with the electrodes along the length of the passage. In the example shown, three channels are interleaved with four electrodes. The order of the electrodes and channels along the length of the passage is electrode 131, channel 141, electrode 132, channel 142, electrode 133, channel 143 and electrode 134. The channels are numbered in order from end 118 of the passage. Odd-numbered ones of the channels, i.e., channels 141 and 143 in this example, extend from the passage to cavity 114. Even-numbered ones of the channels, i.e., channel 142 in this example, extend from the passage to cavity 116. The channels have smaller cross-sectional dimensions than the passage.

Non-conductive fluid 122 is located in cavity 114 and in channels 141 and 143. Non-conductive fluid 124 is located in cavity 116 and in channel 142. Heaters, shown schematically at 150 and 152, are located in cavities 114 and 116, respectively.

Conductive liquid 126 is located in passage 112. The volume of the conductive liquid is less than that of the passage so that the conductive liquid does not completely fill the passage. The remaining volume of the passage is occupied by non-conductive fluid 122 or 124, depending on the switching state of switch device 100. The conductive liquid can be regarded as being composed of conductive liquid portions 161, 162, 163 and 164, each associated with a respective one of electrodes 131, 132, 133 and 134. However, except during switching transitions, the conductive liquid exists in fewer than four conductive liquid portions because various adjacent pairs of the conductive liquid portions unite to form larger conductive liquid portions. The conductive liquid portion formed by the union of a pair of conductive liquid portions will be referred to by the reference numerals of the contributing conductive liquid portions. For example, conductive liquid portion 162,163 shown in FIG. 3A is the conductive liquid portion formed by the union of conductive liquid portions 162 and 163.

Switch device 100 is fabricated in the substrates 170 and 172 shown in FIG. 3C. The material of the substrates is an electrically-insulating material; for example, a glass, a semiconductor such as silicon or a ceramic such as alumina or beryllia. The major surface 174 of substrate 170 is substantially plane. The elements of switch device 100, including cavities 114 and 116, channels 141, 142 and 143 and passage 112, extend depthwise into substrate 172 from major surface 176. Processes for removing material from a substrate to define such elements are known in the art and will not be described here. Suitable removal methods include wet or dry etching or ablation, for example.

FIG. 3C shows an example in which substrate 172 is a wafer of glass, semiconductor or ceramic in which trenches 178, 179, 180 and 181 are formed by an ablation process, such as blasting using particles of alumina. Additional trenches (not shown) that form parts of channels 142 and 143 are also formed in substrate 172. The trenches that form parts of channels 141–143 have a cross-sectional area substantially less than that of trench 178 that forms part of passage 112.

Trench 178 forms part of passage 112, and the wall 182 of trench 178 forms part of the wall of the passage. The remainder of the wall of the passage is formed by the part of the major surface 174 of substrate 170 that overlaps the trench. Trench 178 has a substantially U-shaped cross-sectional shape. Other cross-sectional shapes, such as square, rectangular, trapezoidal, semi-circular and semi-elliptical, are possible.

Trenches 179 and 180 and the portion of the major surface 174 of substrate 170 that overlaps these trenches form cavities 114 and 116.

Trench 181 and the portion of the major surface 174 of substrate 170 that overlaps this trench form channel 141. Channels 142 and 143 are formed by trenches (not shown) in substrate 172 and the portion of the major surface 174 of substrate 170 that overlaps these trenches.

A patterned layer of metal is deposited on the portion of the major surface 174 of substrate 170 overlaying passage 112 to provide electrodes 131–134. Electrode 132 is shown in FIG. 3C. The same patterned layer of metal can additionally be deposited on the portion of the major surface 174 overlaying cavities 114 and 116 to provide heaters 150 and 152. Alternatively, a patterned layer of a different metal having a higher resistivity may be used to provide the heaters.

Conductors (not shown) electrically connected to one or more of electrodes 131–134 may additionally be located on the major surface 174 of substrate 170. Such conductors can be formed in the same process as electrodes 131–134. FIG. 3C additionally shows ground plane 182 composed of a conductive layer located on the major surface 184 of substrate 170, opposite major surface 174. Ground plane 182 converts the conductors (not shown), the electrodes and the conductive liquid portions 161–164 located in passage 112 into striplines. The dimensions of the passage, the electrodes and the conductors are designed to provide the conductors, the electrodes and the conductive liquid portions 161–164 with a specific characteristic impedance that matches the characteristic impedance of the system in which switch device 100 will be used. The characteristic impedance is typically 50 Ω, but other characteristic impedances, such as 75 Ω may alternatively be used. Structuring the passage and the electrodes as striplines that have a specific characteristic impedance that matches the characteristic impedance of the system in which the switch device will be used gives switch device 100 excellent insertion properties over a frequency range that extends to substantially higher frequencies than the conventional switch devices described above.

Alternatively, the conductors (not shown) and associated parts of ground plane 182 may be omitted. In this case, the connections are made to electrodes 131–134 using coaxial cables. In this case, passage 112 and the electrodes are dimensioned to give a characteristic impedance that matches that of the coaxial cables.

Switch device 100 is assembled with the major surface 174 of substrate 170 juxtaposed with the major surface 176 of substrate 172. Assembling switch device 100 locates electrodes 131–134 on substrate 170 along the length of trench 178 and encloses trench 178 to form passage 112. Assembling the switch device also locates heaters 150 and 152 on substrate 170 opposite trenches 179 and 180 and encloses trenches 179 and 180 to form cavities 114 and 116. Assembling the switch device also encloses trench 181 to form channel 141. Channels 142 and 143 are formed by major surface 174 enclosing the additional trenches (not shown) formed in substrate 172. A predetermined volume of the conductive liquid, less than that of passage 112, is placed in trench 178 prior to assembly. If non-conductive fluid 122 and 124 is a liquid, cavities 112 and 114 and channels 141, 142 and 143 are filled with the non-conductive fluid prior to assembly. If the non-conductive fluid is a gas, assembly is performed in an atmosphere of the non-conductive fluid so that the non-conductive fluid fills the cavities and the channels.

Operation of switch device 100 will now be described with reference to FIGS. 3A and 3B. Heater 150 is energized to change the switching state of switch device 100 to the switching state shown in FIG. 3A. Heat generated by the energized heater causes non-conductive fluid 122 in cavity 114 to expand. The resulting excess volume of the non-conductive fluid is expelled into passage 112 through channels 141 and 143. The non-conductive fluid breaks the continuity of conductive liquid 126 at the outlet of the channels. Thus, conductive liquid 126 is broken into conductive liquid portions 161, 162, 163 and 164 when heater 150 is energized.

Heater 152 is energized to change the switching state of switch device 100 to the switching state shown in FIG. 3B. Heat generated by the energized heater causes non-conductive fluid 124 in cavity 116 to expand. The resulting excess volume of the non-conductive fluid is expelled into passage 112 through channel 142. The non-conductive fluid breaks the continuity of conductive liquid 126 at the outlet of the channel. Conductive liquid 126 is broken into conductive liquid portions 161,162 and 163,164 when heater 152 is energized.

In the switching state of switch device 100 shown in FIG. 3A, heat generated by heater 150 has caused non-conductive fluid 122 to expand, and the excess volume of non-conductive fluid 122 has been expelled though channels 141 and 143 into passage 112. Non-conductive fluid 122 entering passage 112 via channel 141 has divided conductive liquid portion 161,162 (FIG. 3B) into conductive liquid portions 161 and 162. Non-conductive fluid 122 entering passage 112 via channel 143 has divided conductive liquid portion 163, 164 (FIG. 3B) into conductive liquid portions 163 and 164. Non-conductive fluid 122 entering passage 112 has additionally expelled non-conductive fluid 124 from the gap between conductive liquid portions 162 and 163 (FIG. 3B). This allows conductive liquid portions 162 and 163 to unite to form conductive liquid portion 162,163. Non-conductive fluid 124 displaced from passage 112 returns to cavity 116 through channel 142.

In the state of switch device 100 shown in FIG. 3B, heat generated by heater 152 has caused non-conductive fluid 124 to expand, and the excess volume of non-conductive fluid 124 has been expelled though channel 142 into passage 112. Non-conductive fluid 124 entering passage 112 has divided conductive liquid portion 162,163 (FIG. 3A) into conductive liquid portions 162 and 163. Non-conductive fluid 124 entering passage 112 has additionally expelled non-conductive fluid 122 from the gap between conductive liquid portions 161 and 162 (FIG. 3A) and from the gap between conductive liquid portions 163 and 164 (FIG. 3A). This allows conductive liquid portions 161 and 162 to unite to form conductive liquid portion 161,162 and allows conductive liquid portions 163 and 164 to unite to form conductive liquid portion 163,164. Non-conductive fluid 122 expelled from passage 112 returns to cavity 114 through channels 141 and 143.

In a practical example of the latching switch device 100, conductive liquid 126 was mercury, the material of electrodes 131–134 was platinum and non-conductive fluid 122 and 124 was nitrogen. Alternative conductive liquids include gallium, sodium-potassium or another conductive material that is liquid at the operating temperature of the switch device. Alternative electrodes materials include lithium, ruthenium, nickel, palladium, copper, silver, gold and aluminum, although not all of these materials are suitable for use with all conductive liquids. For example, copper, silver and gold electrodes are not suitable for use with mercury. Alternative non-conductive fluids include argon, helium, carbon dioxide, other inert gases and gas mixtures and non-conducting organic liquids and gases, such as fluorocarbons.

In one example, trench 178 was about 0.1 to about 0.2 mm wide, about 0.1 mm or about 0.2 mm deep and about 1 mm to about 3 mm long. The trenches that, when covered by substrate 170, constitute channels 141, 142 and 143 were about 30 $\mu$m to about 100 $\mu$m wide and about 30 $\mu$m to about 100 $\mu$m deep, and in any case were narrower and shallower than trench 178. The overall volume of the example was about 0.02 ml. The trenches were formed in a substrate of glass by ablation.

The above-described materials and dimensions are also suitable for use in the embodiments of the conductive liquid-based latching switch devices described below.

Materials other than glass, semiconductor or ceramic may be used as substrates 170 and 172. For example, the elements of the switch device may be molded in a substrate 172 of a moldable material, such as a moldable plastic. A similar material may be used for substrate 170.

Figure 4A:
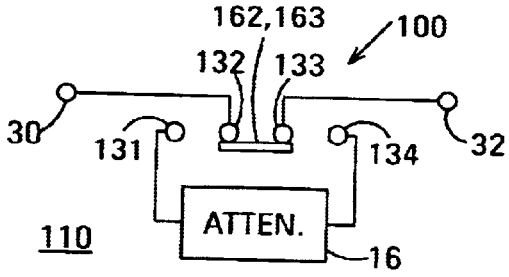
FIGS. 4A and 4B are schematic diagrams of an example of a step attenuator for high-frequency signals incorporating the first embodiment of the multi-pole conductive liquid-based switch device according to the invention in switching states corresponding to those shown in FIGS. 3A and 3B, respectively.
Figure 4B:
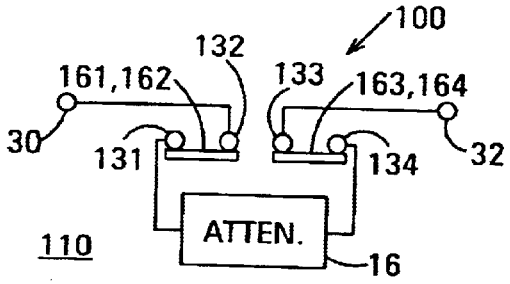

FIGS. 4A and 4B schematically show the application of switch device 100 in a step attenuator 110 functionally similar to step attenuator 10 described above with reference to FIG. 1. Elements of step attenuator 110 that correspond to step attenuator 10 are indicated using the same reference numerals and will not be described in detail here.

Step attenuator 110 will be described with reference to FIGS. 4A and 4B and with additional reference to FIGS. 3A and 3B. Step attenuator 110 is composed of switch device 100, signal connections 30 and 32 and attenuator 16. The ends of attenuator 16 are electrically connected to electrode 131 and electrode 134 of switch device 100. Signal connections 30 and 32 are electrically connected to electrodes 132 and 133, respectively, of switch device 100.

FIG. 4A shows step attenuator 110 with switch device 100 in the switching state shown in FIG. 3A. Non-conductive fluid 122 from channel 141 isolates conductive liquid portion 161 from conductive liquid portion 162 and electrically insulates electrode 131 in contact with conductive liquid portion 161 from electrode 132 in contact with conductive liquid portion 162. This insulates attenuator 16 from signal connection 30. Non-conductive fluid 122 from channel 143 isolates conductive liquid portion 164 from conductive liquid portion 163, and therefore electrically insulates electrode 134 in contact with conductive liquid portion 164 from electrode 133 in contact with conductive liquid portion 163. This insulates attenuator 16 from signal connection 32. Finally, conductive liquid portion 162,163 electrically connects electrodes 132 and 133, and therefore electrically connects signal connections 30 and 32. Electrode 132, conductive liquid portion 162,163, and the electrode 133 are structured to constitute a transmission line having a characteristic impedance that matches that of the connections made to signal connections 30 and 32. This minimizes the insertion loss of step attenuator 110 in the switching state shown in FIG. 4A.

FIG. 4B shows step attenuator 110 with switch device 100 in the switching state shown in FIG. 3B. Conductive liquid portion 161,162 electrically connects electrodes 131 and 132. This electrically connects one end of attenuator 16 to signal connection 30. Additionally, conductive liquid portion 163,164 electrically connects electrodes 133 and 134. This electrically connects the other end of attenuator 16 to signal connection 32. Finally, non-conductive fluid 124 isolates conductive liquid portion 161,162 from conductive liquid portion 163,164. Thus, non-conductive fluid 124 electrically insulates electrode 132, which is in contact with conductive liquid portion 161,162, from electrode 133, which is in contact with conductive liquid portion 163,164. This electrically insulates signal connection 32 from signal connection 30. Consequently, the electrical connection between signal connections 30 and 32 is through attenuator 16 in the switching state shown in FIG. 4B.

The energy consumption of switch device 100 according to the invention is reduced by structuring passage 112 to include a latching structure associated with each of channels 141, 142 and 143. The latching structures enable heaters 150 and 152 to be de-energized after changing the switching state of the switch device without the risk that the switch device will revert to its former switching state or to an indeterminate switching state. Energizing the heaters only to change the switching state of the switch, and not to maintain the switch device in the switching state to which it has been switched, substantially reduces the power consumption of the switch device.

Figure 5:
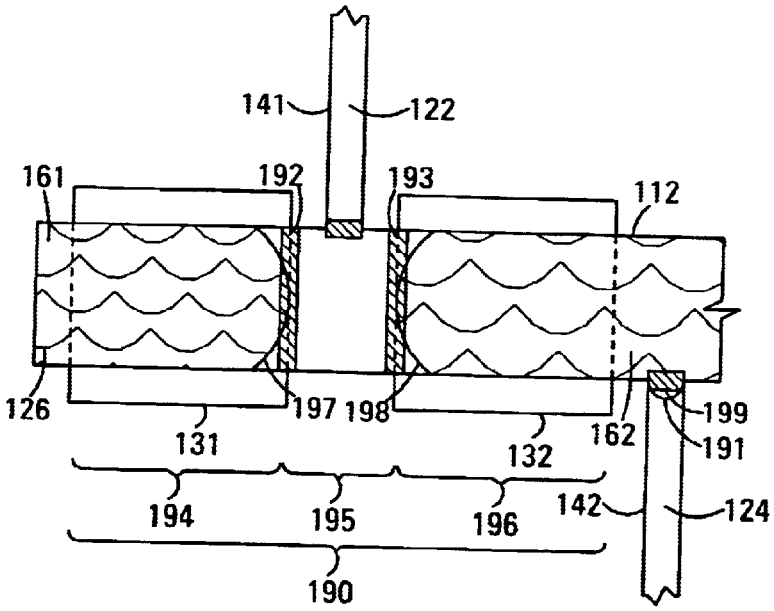
FIG. 5 is an enlarged view of a portion of the passage of the switch device shown in FIG. 3A showing the location of a latching structure and an energy barrier.

The latching structure associated with each channel is composed of an energy barrier located between the channel and the adjacent electrodes. FIG. 5 is an enlarged view of the portion of passage 112 that includes channels 141 and 142 and electrodes 131 and 132. The portion of the passage shown includes latching structure 190 associated with channel 141. Latching structure 190 is composed of energy barrier 192 and energy barrier 193 located on opposite sides of channel 141.

Latching structure 190 will now be described in more detail. The latching structures associated with channels 142 and 143 are similar, and so will not be separately described. Latching structure 190 is composed of low surface energy portion 194, high surface energy portion 195 and low surface energy portion 196 arranged in tandem along part of the length of passage 112. High surface energy portion 195 is located closer to channel 141 than low surface energy portions 194 and 196. Low surface energy portions 194 and 196 are the portions of the passage adjacent high surface energy portion 195. Energy barriers 192 and 193 exist at the junctions between high surface energy portion 195 and each of low surface energy portions 194 and 196, the low energy side of the energy barrier being towards the low surface energy portion, i.e., closer to electrodes 131 and 132 than channel 141.

Each conductive liquid portion has at least one surface in contact with non-conductive fluid 122 or 124. Such surface will be called a free surface to distinguish it from a surface of the conductive liquid portion bound by channel 112. In the example shown, non-conductive fluid 122 divides the conductive liquid into conductive liquid portions 161 and 162 having the free surfaces 197 and 198, respectively. The materials of substrates 170 and 172 in which passage 112 is formed have a relatively low wettability with respect to the conductive liquid 126, whereas the metal of electrodes 131–134 has a substantially higher wettability with respect to the conductive liquid. As a result, the free surfaces 197 and 198 of the conductive liquid portions 161 and 162, respectively, have a greater radius of curvature and, hence, a lower surface energy, when in contact with electrode 131 or 132, respectively, than when in contact with high surface energy portion 195 of the passage between the electrodes. The difference in the surface energy of free surfaces 197 and 198 between high surface energy portion 195 and low surface energy portions 194 and 196, respectively, creates energy barriers 192 and 193, respectively. After free surfaces 197 and 198 have been moved to the low-energy sides of energy barriers 192 and 193, respectively, by non-conductive fluid 122 output from channel 141, the energy barriers will hold the free surfaces on their low energy sides. A substantial input of energy is required to move free surfaces 197 and 198 over energy barriers 192 and 193, respectively, and into contact with one another.

For example, consider the switching state shown in FIG. 5, which corresponds to the switching state shown in FIG. 3A. When switch device 100 is switched into this switching state, non-conductive fluid 122 separates conductive liquid portion 161,162 (FIG. 3B) into conductive liquid portions 161 and 162. Non-conductive fluid 122 moves the free surfaces 197 and 198 of conductive liquid portions 161 and 162, respectively, away from channel 141. The free surfaces move through high surface energy portion 195 of passage 122 into low surface energy portions 194 and 196, respectively. Additionally, conductive liquid portion 162 unites with conductive liquid portion 163 to form conductive liquid portion 162,163, as described above with reference to FIG. 3A.

When heater 150 is de-energized after it has switched switch device 100 to the switching state shown in FIG. 5, non-conductive fluid 122 cools and contracts. Contraction tends to withdraw non-conductive fluid 122 from the gap between conductive liquid portions 161 and 162. Absent latching structure 190, withdrawal of the non-conductive fluid would potentially allow conductive liquid portions 161 and 162 to re-unite.

In switch device 100 according to the invention, however, when heater 150 is de-energized after establishing the switching state shown in FIG. 5, energy barrier 192 formed by low surface energy portion 194 and high surface energy portion 195 resists movement of the free surface 197 of conductive liquid portion 161 into high surface energy portion 195. Similarly, energy barrier 193 formed by low surface energy portion 196 and high surface energy portion 195 resists movement of the free surface 198 of conductive liquid portion 162 into high surface energy portion 195. An input of energy greater than that available from the contraction of non-conductive fluid 122 is required to move free surfaces 197 and 198 over energy barriers 192 and 193, respectively, across high surface energy portion 195 and into contact with one another. Thus, latching structure 190 maintains the electrical connection between electrodes 131 and 132 in an open state. Similarly, the latching structure associated with channel 143 holds the free surfaces of conductive liquid portions 163 and 164 (FIG. 3A) apart from one another, which maintains electrodes 163 and 164 in a disconnected state. In the switching state shown in FIG. 3B, the latching structure associated with channel 142 holds the free surfaces of conductive liquid portions 162 and 163.

In the switching state shown in FIG. 3A, the free surface 198 of conductive liquid portion 162 is held by energy barrier 193, and the free surface of conductive liquid portion 163 is held by the energy barrier extant between electrode 133 and channel 143. The cross-sectional dimensions of channel 142 are substantially smaller than those of passage 112. The difference in cross-sectional dimensions forms energy barrier 199 at the junction of channel 142 and passage 112. Energy barrier 199 prevents the free surface 191 of conductive liquid portion 162,163 from entering passage 142. Thus, the form of conductive liquid portion 162,163 is well defined by passage 112, energy barrier 199 at the junction of channel 142 and passage 112 and the energy barriers at both ends of the conductive liquid portion. This substantially reduces the likelihood of conductive liquid portion 162,163 fragmenting into conductive liquid portions that open the electrical connection between electrodes 132 and 133. Consequently, latching structures associated with channels 141 and 143 and energy barrier 199 maintain switch device 100 in the switching state shown in FIG. 5 after heater 150 has been de-energized.

Energy barriers additionally exist at the intersections of channels 141 and 143 to hold the free surfaces of conductive liquid portions 161,162 and 162,163 at channels 141 and 143 in the switching state shown in FIG. 3B.

If hydraulic or pneumatic losses in the channels are a concern, the channels may be shaped to include a constriction in which the channel has substantially smaller cross-sectional dimensions than passage 112 over only part of its length. The constriction may be located at the intersection of the channel and the passage, for example.

The input of energy required to move the free surfaces of conductive liquid portions 161 and 162 and of conductive liquid portions 163 and 164 over their respective energy barriers and into contact with one another is less than that available from the expansion of non-conductive fluid 124 in response to heater 152. Thus, energizing heater 152 provides sufficient energy to move the free surfaces of conductive liquid portions 162 and 163 over their respective energy barriers and into contact with conductive liquid portions 161 and 164, respectively, to switch the switch device 100 to the switching state shown in FIG. 3B.

The condition that the energy supplied by the contraction of non-conductive fluid 122 be insufficient to move the free surfaces of conductive liquid portions 161 and 162 over their respective energy barriers and into contact with one another and to move the surfaces of conductive liquid portions 163 and 164 over their respective energy barriers and into contact with one another, but that the energy supplied by the expansion of non-conductive fluid 124 be sufficient to move the above-mentioned surfaces into contact with one another is achieved by suitably sizing cavities 114 and 116. In particular, cavities should have a ratio of volumes substantially proportional to the ratio of the number channels that connect to them. In the example shown, cavity 114 to which channels 141 and 143 connect should have approximately twice the volume of cavity 116 to which channel 142 connects.

In embodiments in which the wettability of the materials of substrates 170 and 172 differs insufficiently from the wettability of the material of electrodes 131–134, the portion of the wall of passage 112 in high surface energy portion 195 may be coated with a material having a lower wettability with respect to conductive liquid 126 than the materials of the substrates. The surface energy of low surface energy portions 194 and 196 may be further reduced by extending the high wettability material of the electrodes, or another high-wettability material, around the periphery of the passage in the low surface energy portions of the passage. The difference in surface energy between high surface energy portion 195 and low surface energy portions 194 and 196 may additionally or alternatively be achieved by shaping passage 112 to have greater cross-sectional dimensions in low surface energy portions 194 and 196 than in high surface energy portion 195.

Latching structures are further described in a patent application filed on the same day as this disclosure and entitled *Conductive Liquid-Based Latching Switch Device.* The application assigned is assigned to the assignee of this disclosure and, for the United States, is incorporated herein by reference.

Figure 6A:
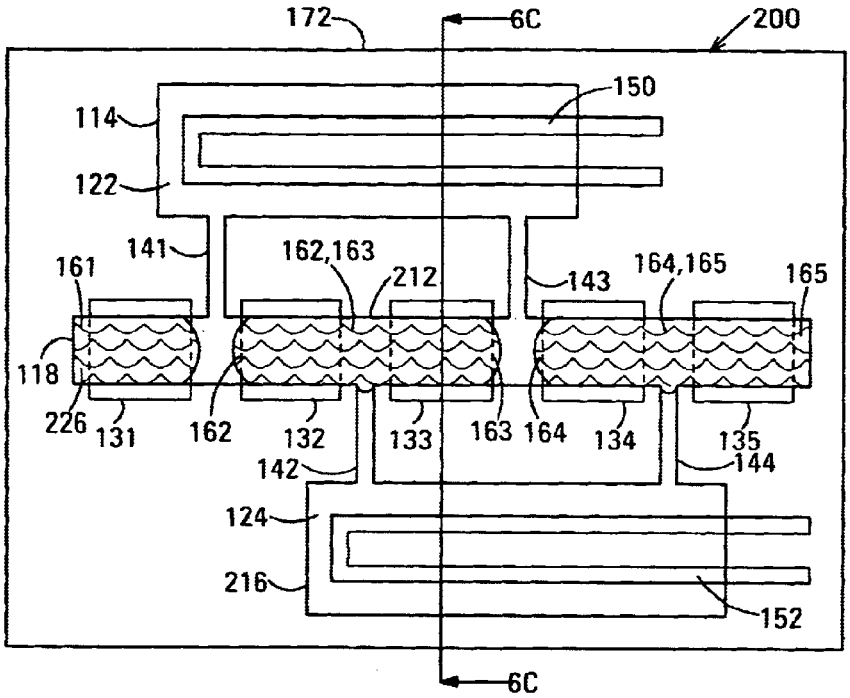
FIG. 6A is a plan view of a second embodiment of a multi-pole conductive liquid-based switch device according to the invention in a first switching state.
Figure 6B:
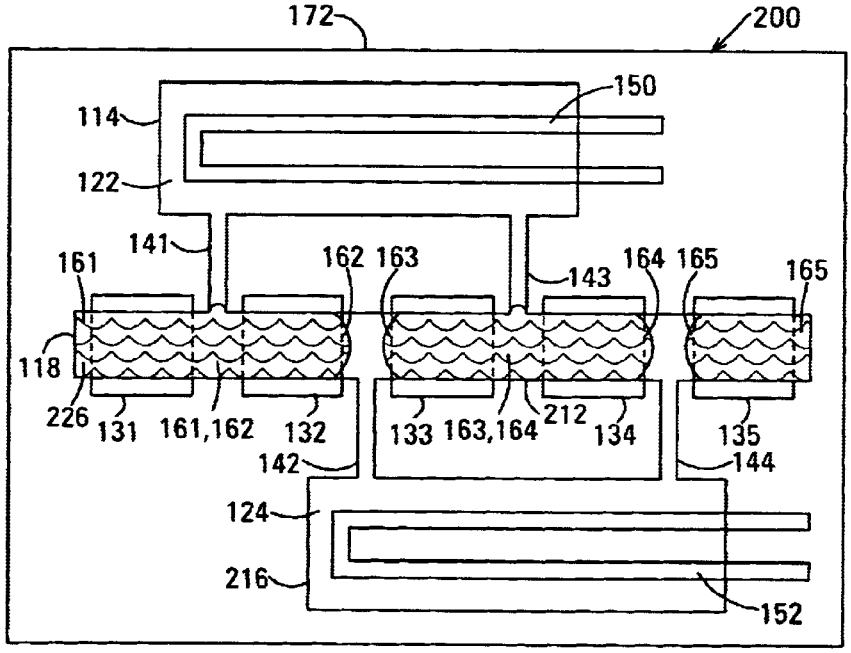
FIG. 6B is a plan view of the second embodiment of the multi-pole conductive liquid-based switch device according to the invention in a second switching state.
Figure 6C:
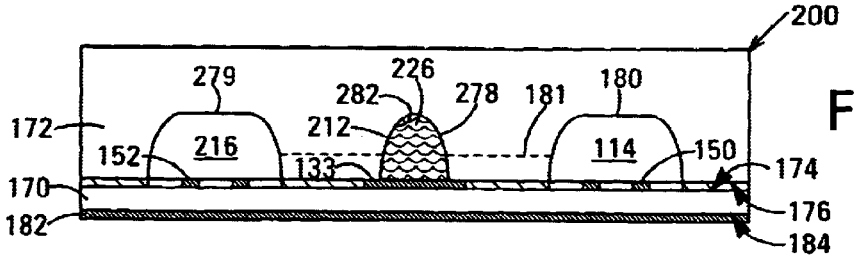
FIG. 6C is a cross-sectional view of the second embodiment of a multi-pole conductive liquid-based switch device according to the invention along the section line 6C—6C shown in FIG. 6A.

A second embodiment 200 of a multi-pole conductive liquid-based switch device according to the invention is shown in a first switching state in FIG. 6A and in a second switching state in FIG. 6B. FIG. 6C shows a cross-sectional view. Elements of switch device 200 that correspond to elements of switch device 100 described above with reference to FIGS. 3A–3C are indicated using the same reference numerals and will not be described in detail again.

Switch device 200 is a five-pole, two-way switch device and is composed of elongate passage 212, cavity 114, cavity 216, electrodes 131, 132, 133, 134 and 135, channels 141, 142, 143 and 144, non-conductive fluid 122 and 124 and conductive liquid 226.

Electrodes 131, 132, 133, 134 and 135 are disposed along the length of passage 212.

Channels 141, 142, 143 and 144 are one fewer in number than the electrodes 131, 132, 133, 134 and 135. The channels extend from passage 212 and are interleaved with the electrodes along the length of the passage, i.e., four channels are interleaved with five electrodes in this embodiment. The order of the electrodes and channels along the length of the passage is electrode 131, channel 141, electrode 132, channel 142, electrode 133, channel 143, electrode 134, channel 144 and electrode 135. The channels are numbered in order from end 118 of the passage. Odd-numbered ones of the channels, i.e., channels 141 and 143, extend from the passage to cavity 114. Even-numbered ones of the channels, i.e., channels 142 and 144, extend from the passage to cavity 216. The channels have smaller cross-sectional dimensions than the passage.

Non-conductive fluid 122 is located in cavity 114 and in channels 141 and 143. Non-conductive fluid 124 is located in cavity 216 and in channels 142 and 144. Heaters, shown schematically at 150 and 152, are located in cavities 114 and 216, respectively.

Conductive liquid 226 is located in passage 212. The volume of the conductive liquid is less than that of the passage so that the conductive liquid does not completely fill the passage. The remaining volume of the passage is occupied by non-conductive fluid 122 or 124, depending on the switching state of switch device 200. The conductive liquid can be regarded as being composed of conductive liquid portions 161, 162, 163, 164 and 165 each associated with a respective one of electrodes 131, 132, 133, 134 and 135. However, except during switching transitions, conductive liquid 226 exists as a smaller number of conductive liquid portions because various adjacent pairs of the conductive liquid portions unite to form larger conductive liquid portions. The conductive liquid portion formed by the union of a pair of conductive liquid portions will be referred to by the reference numerals of the contributing conductive liquid portions. For example, conductive liquid portion 162,163 is the conductive liquid portion formed by the union of conductive liquid portions 162 and 163.

Switch device 200 is fabricated in substrates 170 and 172 shown in FIG. 6C in a manner similar to that described above with reference to FIGS. 3A–3C. Additional electrode 165 is located on the major surface 174 of substrate 170. An optional conductor (not shown) that forms a strip line with ground plane 182 may extend over major surface 174 to electrode 165 in a manner similar to that described above. An additional trench (not shown) extending between trench 278 and trench 279 is formed in substrate 172. The additional trench and the portion of the major surface 174 of substrate 170 that overlaps this trench form channel 144.

Latching structures similar to latching structure 190 described above with reference to FIG. 5 are located at each of channels 141, 142, 143 and 144. Energy barriers similar to energy barrier 199 described above with reference to FIG. 5 are located at the intersections of channels 141, 142, 143 and 144 and passage 212.

Operation of switch device 200 will now be described with reference to FIGS. 6A and 6B. Heater 150 is energized to change the switching state of switch device 200 to the switching state shown in FIG. 6A. Heat generated by the energized heater causes non-conductive fluid 122 in cavity 114 to expand. The resulting excess volume of the non-conductive fluid is expelled into passage 212 through channels 141 and 143. The non-conductive fluid breaks the continuity of conductive liquid 226 at the outlets of the channels. Thus, conductive liquid 226 is broken into conductive liquid portions 161, 162,163 and 164,165 when heater 150 is energized. Heater 152 is energized to change the switching state of switch device 200 to the switching state shown in FIG. 6B. Heat generated by the energized heater causes non-conductive fluid 124 in cavity 216 to expand. The resulting excess volume of the non-conductive fluid is expelled into passage 212 through channels 142 and 144. The non-conductive fluid breaks the continuity of conductive liquid 226 at the outlets of the channels. Thus, when heater 152 is energized conductive liquid 226 is broken into conductive liquid portions 161,162, 163,164 and 165. These conductive liquid portions are different from the conductive liquid portions into which conductive liquid 226 is broken when heater 150 is energized.

In the switching state of switch device 200 shown in FIG. 6A, heat generated by heater 150 has caused non-conductive fluid 122 to expand, and the excess volume of non-conductive fluid 122 has been expelled though channels 141 and 143 into passage 212. Non-conductive fluid 122 entering passage 212 through channel 141 has divided conductive liquid portion 161,162 (FIG. 6B) into conductive liquid portions 161 and 162. Non-conductive fluid 122 entering passage 212 through channel 143 has divided conductive liquid portion 163,164 (FIG. 6B) into conductive liquid portions 163 and 164. Non-conductive fluid 122 entering passage 212 has also expelled non-conductive fluid 124 from the gap between conductive liquid portions 162 and 163 (FIG. 6B) and from the gap between conductive liquid portions 164 and 165 (FIG. 6B). Non-conductive fluid 122 moves conductive liquid portions 162 and 163 in opposite directions in the passage into contact with one another. Conductive liquid portions 162 and 162 unite to form conductive liquid portion 162,163. Non-conductive fluid 122 moves conductive liquid portion 164 in the passage into contact conductive liquid portion 165. Conductive liquid portions 165 and 165 unite to form conductive liquid portion 164,165. Non-conductive fluid 124 expelled from passage 212 returns to cavity 216 through channels 142 and 144.

In the state of switch device 200 shown in FIG. 6B, heat generated by heater 152 has caused non-conductive fluid 124 to expand, and the excess volume of non-conductive fluid 124 has been expelled though channels 142 and 144 into passage 212. Non-conductive fluid 124 entering passage 212 through channel 142 has divided conductive liquid portion 162,163 (FIG. 6A) into conductive liquid portions 162 and 163. Non-conductive fluid 124 entering passage 212 through channel 144 has divided conductive liquid portion 164,165 (FIG. 6A) into conductive liquid portions 164 and 165. Non-conductive fluid 124 entering passage 212 has additionally expelled non-conductive fluid 122 from the gap between conductive liquid portions 161 and 162 and from the gap between conductive liquid portions 163 and 164. Non-conductive fluid 124 moves conductive liquid portion 162 in the passage into contact with conductive liquid portion 161. Conductive liquid portions 161 and 162 unite to form conductive liquid portion 161,162. Non-conductive fluid 124 additionally moves conductive liquid portions 163 and 164 in opposite directions in the passage into contact with one another. Conductive liquid portions unite to form conductive liquid portion 163,164. Non-conductive fluid 122 expelled from passage 112 returns to cavity 114 through channels 141 and 143.

Figure 7A:
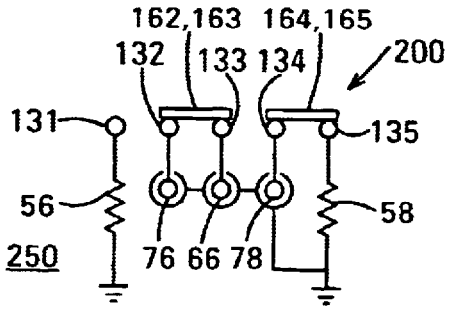
FIGS. 7A and 7B are schematic diagrams of an example of an impedance-matched, singe-pole, double throw switch for high-frequency signals incorporating the second embodiment of the multi-pole conductive liquid-based switch device according to the invention in switching states corresponding to those shown in FIGS. 6A and 6B, respectively.
Figure 7B:
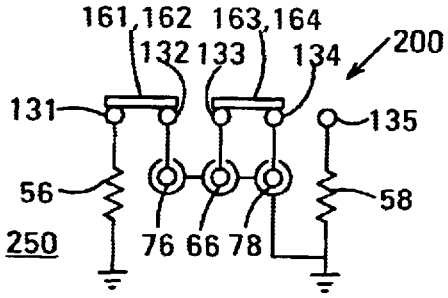

FIGS. 7A and 7B schematically show the application of switch device 200 to an impedance-matched, single-pole, double-throw switch 250 functionally similar to switch 50 described above with reference to FIG. 2. Elements of switch 250 that correspond to elements of switch 50 are indicated using the same reference numerals and will not be described in detail here.

Switch 250 is composed of switch device 200, termination resistors 56 and 58 and signal connections 66, 76 and 78. Electrode 131 of switch device 200 is connected to ground via termination resistor 56 and electrode 135 of switch device 200 is connected to ground via termination resistor 58. Termination resistors 56 and 58 have a resistance equal to the characteristic impedance of the system in which switch 250 is to be used. The characteristic impedance is typically 50 Ω, as noted above. Electrodes 132, 133 and 134 of switch device 200 are electrically connected to signal connections 76, 66 and 78, respectively.

FIG. 7A shows switch 250 with switch device 200 in the switching state shown in FIG. 6A. In this, non-conductive fluid 122 isolates conductive liquid portion 161 from conductive liquid portion 162. Hence, non-conductive fluid electrically 122 insulates electrode 131 in contact with conductive liquid portion 161 from electrode 132 in contact with conductive liquid portion 162, and insulates termination resistor 56 from signal connection 76. Non-conductive fluid 122 additionally isolates conductive liquid portion 164 from conductive liquid portion 163. Hence, non-conductive fluid 122 electrically insulates electrode 134 in contact with conductive liquid portion 164 from electrode 133 in contact with conductive liquid portion 163, and insulates signal connection 78 from signal connection 66.

Conductive liquid portion 162,163 electrically connects electrodes 132 and 133, and therefore electrically connects signal connection 76 to signal connection 66. Finally, conductive liquid portion 164,165 electrically connects electrodes 134 and 135, and hence electrically connects signal connection 78 to ground through termination resistor 58. Accordingly, signal connections 66 and 76 are electrically connected and "open" signal connection 78 is grounded via termination resistor 58.

Electrode 132, conductive liquid portion 162,163 and electrode 133 are structured to constitute a transmission line having a characteristic impedance equal to that the system in which switch 250 is to be used. This minimizes transmission losses in the signal connection between signal connections 66 and 76. Similarly, electrode 134, conductive liquid portion 164,165 and the electrode 135 are structured to constitute a transmission line having the same characteristic impedance to optimize matching between signal connection 78 and termination resistor 58.

FIG. 7B shows switch 250 with switch device 200 in the switching state shown in FIG. 6B. In this, non-conductive fluid 124 isolates conductive liquid portion 162 from conductive liquid portion 163. Hence, non-conductive fluid 124 electrically insulates electrode 132 in contact with conductive liquid portion 162 from electrode 133 in contact with conductive liquid portion 163, and insulates signal connection 66 from signal connection 76. Non-conductive fluid 124 additionally isolates conductive liquid portion 164 from conductive liquid portion 165. Hence, non-conductive fluid 124 electrically insulates electrode 134 in contact with conductive liquid portion 164 from electrode 135 in contact with conductive liquid portion 165, and insulates signal connection 78 from termination resistor 58.

Conductive liquid portion 161,162 electrically connects electrodes 131 and 132, and therefore electrically connects signal connection 76 to ground through termination resistor 56. Finally, conductive liquid portion 163,164 electrically connects electrodes 133 and 134, and therefore electrically connects signal connection 66 to signal connection 78. Accordingly, signal connections 66 and 78 are electrically connected and "open" signal connection 76 is grounded via termination resistor 56.

Electrode 133, conductive liquid portion 163,164 and electrode 134 are structured to constitute a transmission line having a characteristic impedance equal to that the system in which switch 250 is to be used. This minimizes transmission losses in the signal connection between signal connections 66 and 78. Similarly, electrode 131, conductive liquid portion 161,162 and the electrode 132 are structured to constitute a transmission line having the same characteristic impedance to optimize matching between signal connection 76 and termination resistor 56.

In applications in which the open signal connection, i.e., signal connection 76 or 78, may be connected directly to ground, termination resistors 56 and 58 are omitted and electrodes 131 and 135 are connected directly to ground.

Figure 8:
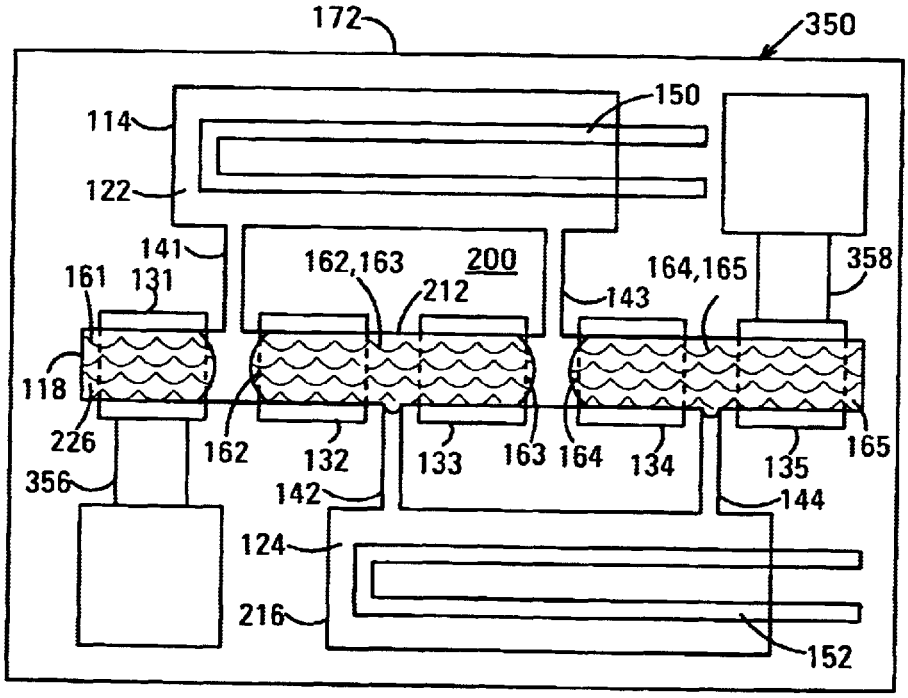
FIG. 8 is a plan view of an integrated, impedance-matched, single-pole, double-throw switch incorporating the second embodiment of the multi-pole conductive liquid-based switch device according to the invention.

FIG. 8 shows an integrated, impedance-matched, single-pole, double-throw switch 350 incorporating the second embodiment 200 of a multi-pole conductive liquid-based switch device according to the invention. Elements of switch 350 that correspond to elements of switch 250 described above with reference to FIGS. 6A and 6B are indicated using the same reference numerals and will not be described in detail again.

Switch 350 is composed of switch device 200 and termination resistors 356 and 358. Switch 350 additionally includes signal connections 66, 76 and 78 (not shown) connected to electrodes 132, 133 and 134, respectively, of switch device 200. Termination resistors 356 and 358 are metal film resistors located on the major surface 174 of substrate 170 (FIG. 6C). One end of termination resistors 356 and 358 is connected to electrodes 131 and 135, respectively, of switch device 200. The other end of termination resistors 356 and 358 is connected to ground. For example, through-hole formed in substrate 170 (FIG. 6C) may be used to connect the ends of termination resistors 356 and 358 to ground plane 182 (FIG. 6C). The termination resistors may be formed in the same process as electrodes 131–135. Alternatively, the termination resistors may be formed in the same process as heaters 150 and 152 if the heaters and electrodes are formed in different processes. Termination resistors 356 and 358 have a resistance equal to the characteristic impedance equal to that the system in which switch 350 is to be used.

The invention has been described with reference to examples in which heaters 150 and 152 are composed of resistors located in cavities 114 and 116, respectively. However, this is not critical to the invention. Non-conductive fluid 122 and 124 may be heated in other ways. For example, cavities 114 and 116 may each be equipped with a radiation absorbing surface, and radiation from a suitable emitter, such as an LED, may be used to heat the non-conductive fluid 122 and 124 via the radiation absorbent surface in the respective cavity. Alternatively, a radiation-absorbent non-conductive fluid may be directly heated by radiation of the appropriate wavelength.

This disclosure describes the invention in detail using illustrative embodiments. However, it is to be understood that the invention defined by the appended claims is not limited to the precise embodiments described.

We claim:

1. A multi-pole, conductive liquid-based switch device, comprising:

a passage, the passage being elongate and having a length;

a first cavity and a second cavity;

at least four electrodes disposed along the length of the passage;

channels, one fewer in number than the electrodes, extending from the passage and interleaved with the electrodes along the length of the passage, the channels being numbered in order from an end of the passage, odd-numbered ones of the channels extending to the first cavity, even-numbered ones of the channels extending to the second cavity;

non-conductive fluid located in the cavities; and conductive liquid located in the passage.

2. The switch device of claim 1, additionally comprising means for selectively heating the non-conductive fluid in each of the cavities.

3. The switch device of claim 1, additionally comprising a ground plane adjacent the passage and the electrodes.

4. The switch device of claim 3, in which the passage and the electrodes are structured to constitute at least part of a transmission line.

5. The switch device of claim 1, in which:

the electrodes number no more than four and are ordinally numbered from the end of the passage;

the switch device additionally comprises:

an electrical attenuator connected between a first and a fourth of the electrodes, and signal connectors electrically connected to a second and a third of the electrodes.

6. The switch device of claim 1, in which:

the electrodes number no more than five and are ordinally numbered from the end of the passage;

the switch device additionally comprises:

a ground connection to a first and a fifth of the electrodes, a signal connection of a first type electrically connected to a third of the electrodes, and a signal connection of a second type electrically connected to each of a second of the electrodes and a fourth of the electrodes.

7. The switch device of claim 6, in which the ground connection to the first and fifth electrodes includes a termination resistor.

8. The switch device of claim 1, additionally comprising a latching structure associated with each one of the channels.

9. The switch device of claim 8, in which each latching structure includes energy barriers that hold apart free surfaces of the conductive liquid.

10. The switch device of claim 9, in which each energy barrier includes a high surface energy portion at one of the channels and a low surface energy portion between the one of the channels and an adjacent one of the electrodes, a free surface of the conductive liquid having a higher surface energy in the high surface energy portion than in the low surface energy.

11. The switch device of claim 10, in which the electrodes are of a material having a higher wettability with respect to the conductive liquid than the passage and provide the low surface energy portion.

12. The switch device of claim 1, in which:

the channels each have a length; and the channels have smaller cross-sectional dimensions than the passage over at least part of their length.

13. The switch device of claim 12, additionally comprising means for selectively heating the non-conductive fluid in each of the cavities.

14. The switch device of claim 12, additionally comprising a ground plane adjacent the passage and the electrodes.

15. The switch device of claim 14, in which the passage and the electrodes are structured to constitute at least part of a transmission line.

16. The switch device of claim 12, in which:

the electrodes number no more than four and are ordinally numbered from the end of the passage;

the switch device additionally comprises:

an electrical attenuator connected between a first and a fourth of the electrodes, and signal connectors electrically connected to a second and a third of the electrodes.

17. The switch device of claim 12, in which:

the electrodes number no more than five and are ordinally numbered from the end of the passage;

the switch device additionally comprises:

a ground connection to a first and a fifth of the electrodes, a signal connection of a first type electrically connected to a third of the electrodes, and signal connection of a second type electrically connected to each of a second of the electrodes and a fourth of the electrodes.

18. The switch device of claim 17, in which the ground connection to the first and fifth electrodes includes a termination resistor.

19. The switch device of claim 12, additionally comprising a latching structure associated with each one of the channels.

20. The switch device of claim 19, in which each latching structure includes energy barriers that hold apart free surfaces of the conductive liquid.

* * * * *